US006428410B1

(12) United States Patent
Campbell

(10) Patent No.: US 6,428,410 B1
(45) Date of Patent: Aug. 6, 2002

(54) VENTURI VENTILATION SYSTEM

(76) Inventor: Michael C. Campbell, 1696 Dey Cove Dr., Virginia Beach, VA (US) 23454

( * ) Notice: Subject to any disclaimer, the term of this patent is extended or adjusted under 35 U.S.C. 154(b) by 0 days.

(21) Appl. No.: 09/811,650

(22) Filed: Mar. 20, 2001

(51) Int. Cl.[7] ..... F24F 7/06
(52) U.S. Cl. ..... 454/344; 137/565.22
(58) Field of Search ..... 137/565.22, 892; 454/49, 61, 344; 417/187; 285/206

(56) References Cited

U.S. PATENT DOCUMENTS 2,014,187 A * 9/1935 Neff ..... 454/344
2,569,319 A * 9/1951 Krug ..... 454/344
3,157,107 A * 11/1964 Kosar ..... 454/344
5,499,945 A 3/1996 Ferlin et al.
6,000,391 A 12/1999 Timmons
6,331,141 B1 * 12/2001 Chua ..... 454/344

FOREIGN PATENT DOCUMENTS

WO 97/48475 * 12/1997

* cited by examiner

*Primary Examiner*—John Rivell
(74) *Attorney, Agent, or Firm*—Birch, Stewart, Kolasch & Birch

(57) ABSTRACT

A vacuum air exhaust system (8) employs a venturi vacuum pump (10) that is fed pressurized air through a control valve unit (18) rigidly mounted on a vacuum pump housing (24) of the vacuum air exhaust system. By manipulating a movable valve of the control valve unit, an operator can control a vacuum applied by the vacuum pump. The vacuum air exhaust system is rigidly attached to a pipe-type mount unit (16) for being rigidly attached to a wall at a hole in the wall so that ventilation suction is applied through the pipe and the wall. In one embodiment the exhaust adapter is attached to a flexible hose (41) and in another embodiment it is rigidly screwed to a pipe (42), such as a filter pipe.

20 Claims, 3 Drawing Sheets

VENTURI VENTILATION SYSTEM

BACKGROUND OF THE INVENTION

This invention relates generally to ventilation, or air exhaust, systems and concerns more specifically such systems that are easy to install, use and control at separate targeted stations of work sites and buildings.

At large work sites, such as in factories, warehouses, storage facilities, repair facilities, and the like, there is often the need to evacuate, and sometimes even to clean, contaminated air at various, particular, work and/or storage stations, while not necessarily ventilating entire work sites. For example, small storage sheds often contain materials producing dangerous fumes and therefore must be individually ventilated. Further, work stations with crushers, balers, part washers, and the like, often produce bad air containing dangerous fumes which should be evacuated to better ventilated areas, or treated locally, to protect workers at or near the stations. The needs at these various stations are diverse, and a number of different types of ventilation systems have been used in the past to provide necessary forced ventilation thereat.

For example, U.S. Pat. No. 5,499,945 to Ferlin, et al., describes a ventilation apparatus for extracting air adjacent selected work stations into a large central exhaust duct that is attached to air moving lines. In this system, there are a number of branches, each branch extending to an air inlet positioned at a suitable location adjacent to a work station. Air movers are supplied with pressurized air to produce venturi effects for sucking air from the different work stations into the central duct. Ferlin et al. points out that this system can be easily added, removed or relocated to different elevations. In one embodiment, there is a venturi connection quite near an inlet port that is supplied with pressurized air. Although this system has some flexibility, it does not provide the necessary customized control for allowing a sufficiently wide range of adjustments necessary to meet diverse situations often encountered at work sites.

U.S. Pat. No. 6,000,391 to Timmons, also describes a positive air flow ventilation system which works on venturi air flow, but which also does not provide sufficient control and structural adaptability to make it useful in the wide range of situations desired.

Other ventilation systems that have been used in the prior art include electric fans placed at exhaust holes in metal cabinets for pulling air out of the cabinets into surrounding atmosphere. One problem with such electric fans is that they cause electrical sparks that could result in igniting flammable fumes. Similarly, they must be supplied with electrical energy that also increases risk of fire.

Therefore, it is an object of this invention to provide an air exhaust system which can be easily custom installed at various stations, whose ventilation suction can be custom controlled at the stations, which does not increase the risk of fire and which provides excellent ventilation at stations by evacuating and/or cleaning their air. It is also an object of this invention to provide such an air exhaust system that is easy to mount on a wall of a housing for evacuating air from the housing.

SUMMARY OF THE INVENTION

According to principles of this invention, a vacuum air exhaust system employs a venturi vacuum pump that is fed pressurized air through a control valve unit rigidly mounted on a vacuum pump housing of the vacuum air exhaust system. By manipulating a movable valve of the control valve unit, an operator can control a vacuum applied by the vacuum pump. The vacuum air exhaust system is, in one embodiment, rigidly attached to a pipe-type mount unit having flanges and/or male threads at an intake end and to an exhaust adapter at an exhaust end. The flanges and/or male threads of the pipe-type mount unit are for engaging a wall so that ventilation suction is applied through the pipe and the wall. In one embodiment the exhaust adapter is attached to a flexible hose and in another embodiment it is rigidly screwed to a pipe, such as a filter pipe.

BRIEF DESCRIPTION OF THE DRAWINGS

Further benefits, characteristics and details of the invention are explained in more detail below using an embodiment shown in the drawings. The described and drawn features can be used individually or in preferred combinations in other embodiments of the invention. The foregoing and other objects, features and advantages of the invention will be apparent from the following more particular description of the preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DETAILED DESCRIPTION OF THE INVENTION

Figure 1:
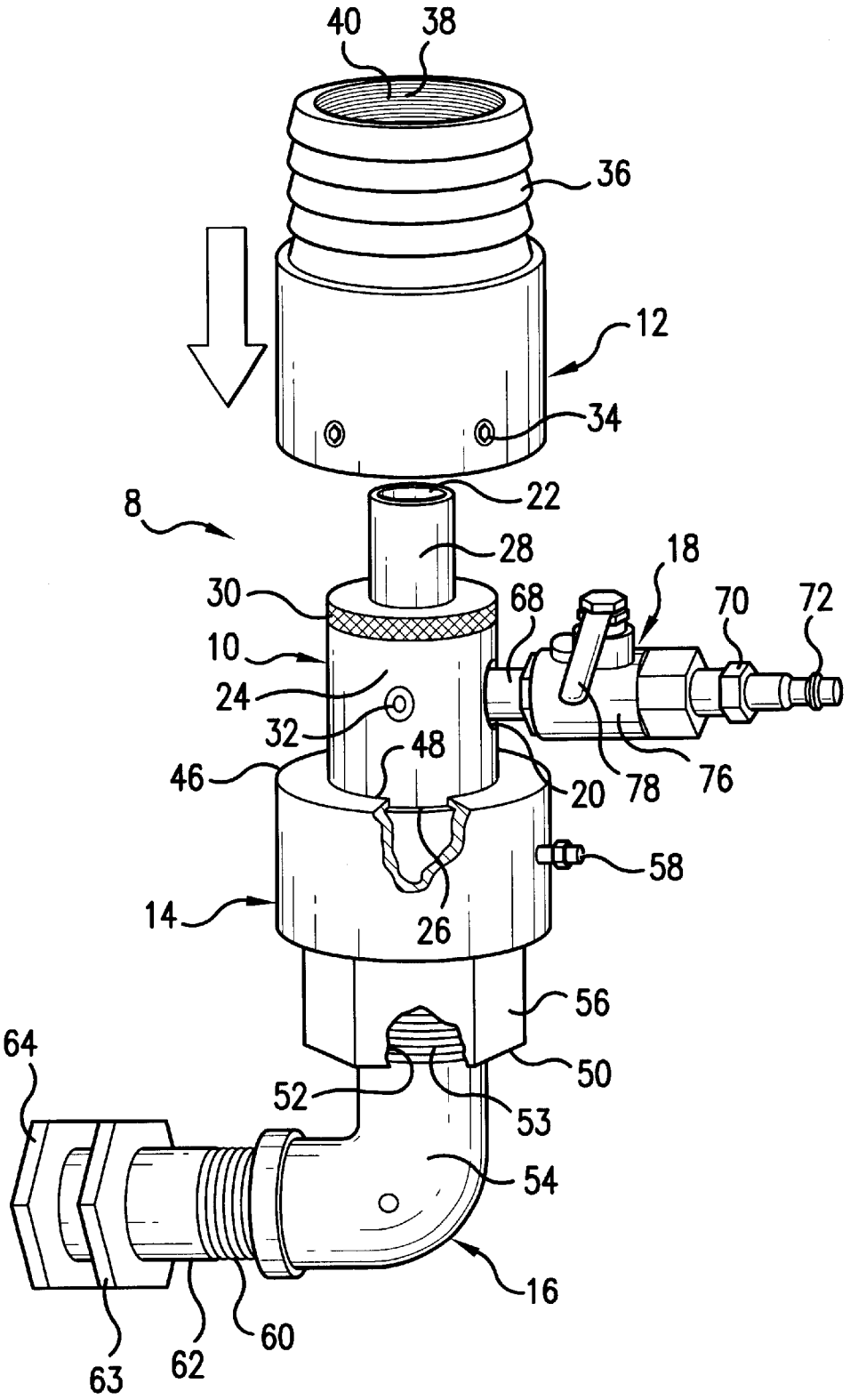
FIG. 1 is an isometric, partially-exploded, view of an embodiment of a vacuum air exhaust system of this invention.

A vacuum air-exhaust, or ventilation, system 8 of this invention includes a vacuum pump 10, an exhaust adapter 12, a control valve unit 18 and a mount system including a mount adapter 14 and a mount unit 16.

The venturi vacuum pump 10 is an off-the-shelf item which can be purchased from various suppliers, with the one shown in FIG. 1 being sold by ANVER under the designation ANVER FT series adjustable flow tubes, this one being identified with the model number FT050. Basically, the vacuum pump 10 receives compressed pressurized air at a compressed-air inlet 20 and exhausts this pressurized air at a pump exhaust port 22. In doing this, a venturi air flow, caused within a vacuum pump housing 24 of the venturi vacuum pump 10, creates a suction at a pump vacuum inlet 26 for sucking contaminated air to be ventilated away from a work station, exhausting it through the pump exhaust port 22 with the compressed air. In the case of the ANVER FT050 vacuum pump, rotation of a pump exhaust tube 28 within the vacuum-pump housing 24 causes air flow through the vacuum-pump housing 24 to either be increased or decreased depending on the direction of its rotation. The pump exhaust tube 28 can be loosened for this rotation by a knurled retaining nut 30, which can be tightened and loosened by rotation. The vacuum pump 24 has indentations 32 on a peripheral surface thereof for being gripped by a tool for rotating the vacuum-pumping housing 24 to screw it to pipes if necessary.

The exhaust adapter 12 can be removably mounted on the vacuum-pump housing 24 by recessed setscrews 34. In this regard, the exhaust adapter 12 has a lower bore (cannot be seen in the drawings) which receives relatively snugly the vacuum-pump housing 24 so that the setscrews 34 can then be tightened on an outer surface of the vacuum-pump housing 24 for holding the exhaust adapter 12 to the vacuum-pumping housing 24. There need not be a sealed contact between the exhaust adapter 12 and the vacuum-pump housing 24 because any gap between these two members will have a suction applied thereto by air flow through the pump exhaust port 22 due to the venturi effect. An outer, or upper, end of the exhaust adapter 12 has external, male, circular ribs 36 and internal, female, threads 38. The internal threads 38 are inside an adapter exhaust port 40 through which forced air containing the driving pressurized air, and ventilated contaminated air carried therewith, passes. The external circular ribs 36 can mate with an internal bore of a flexible evacuation hose 41 (see FIG. 3) and the internal threads 38 can engage a rigid evacuation pipe (not shown) or a rigid filter pipe 42 of a local filter 44 (shown in FIG. 2).

Looking now more particularly at the mount adapter 14, this element has at a first end 46 an opening 48 for receiving a bottom end of the vacuum-pump housing 24 and at its second end 50 a threaded opening 52 for receiving male threads 53 of a pipe 54 of the mount unit 16. The outer surface of the vacuum pump housing 24 is adhered to an interior surface of the opening 48 of the mount adapter 14 by an epoxy resin. The mount adapter 14 has a flat-sided surface 56 at its second end 50. A ground wire attachment 58 is on an outer peripheral surface of the mount adapter 14 for grounding the entire ventilation system 8.

Describing now the mount unit 16, in the embodiment depicted in FIG. 1, this unit includes an elbow pipe 54 having the male threads 53 at one end and female threads for mating with male threads 60 of a pipe-like mounting flange member 62 at the other end. The mount unit 16, in the depicted embodiment, also includes the mounting flange member 62 and an outside retaining nut 64 which can be screwed onto threads at an outer end of the mounting flange member 62. A mounting flange 63 of the mounting flange member 62 and the outside retaining nut 64 clamp onto a wall of a closet 66, or the like, so that air and fumes from the closet 66 can be sucked through the wall by the mounting flange member 62 and into the pipe 54 of the mount unit 16. In one embodiment, not depicted, the mount unit 16 simply has male threads at its free end for engaging female threads at a hole in a wall.

Looking now at the control valve unit 18 in more detail, this element includes an output nipple 68 which can be screwed into the compressed-air inlet 20 of the vacuum pump 10, an inlet nipple 70 whose upstream end 72 can be engaged with a compressed-air source hose 74 and a ball valve unit 76 between the output and input nipples 68 and 70 for controlling flow between the output and input nipples. In this regard, a manual lever 78 is attached to a ball valve member (not shown) and is used for rotating the ball valve member within the ball-valve unit, with the ball valve member being in a closed position when the lever 78 is perpendicular to flow of fluid through the control valve unit 18, as depicted in FIG. 1, and being in an open position when the lever 78 is parallel to the control valve unit 18, as is depicted in FIGS. 2 and 3.

Describing now operation of the ventilation system of this invention, the vacuum ventilation system 8 may be mounted directly to the closet, or cabinet, 66 by drilling a 1-inch hole at a lower part of the cabinet. Ideally, a ⅞ to 1 inch hole drilled 10 to 12 inches from the floor, on center, is best so that the vacuum ventilation system can evacuate contaminated fumes that are heavier than air and therefore fall. The outside retaining nut 64 is removed from the mounting flange member 62 and an outer end of the mounting flange member 62 is extended through the drilled hole. The outside retaining nut is then screwed onto the mounting flange member 62 from inside the cabinet 66 and hand tightened. It is noted that the mount unit 16 can have other configurations, such being formed of a magnetic mounting base, as described in U.S. Pat. No. 5,499,945 to Ferlin et al. However, the pipe-type mount in the depicted embodiment has many advantages, even when there is no cabinet, rather just a wall, involved. Some cabinets and housings have an appropriate female-threaded hole, so that the pipe-type mount need not have any flanges at all, but rather has male threads for screwing directly into a housing female-threaded hole. Also, an adaptor with female threads could be attached to a wall at a hole therethrough for engaging male threads of the pipe mount. In one case, the pipe-type mount unit only has the flange 63 and not the nut 64. In any case, the flanges (nut) provide a highly adaptable mount system.

A ground wire is attached to the ground wire attachment 58 for electrically grounding the vacuum ventilation system to avoid buildup of static electricity. The compressed-air-source hose 74 is slid over the upstream end 72 of the input nipple 70 of the control valve unit 18 for providing basically unregulated pressurized air thereto.

Figure 2:
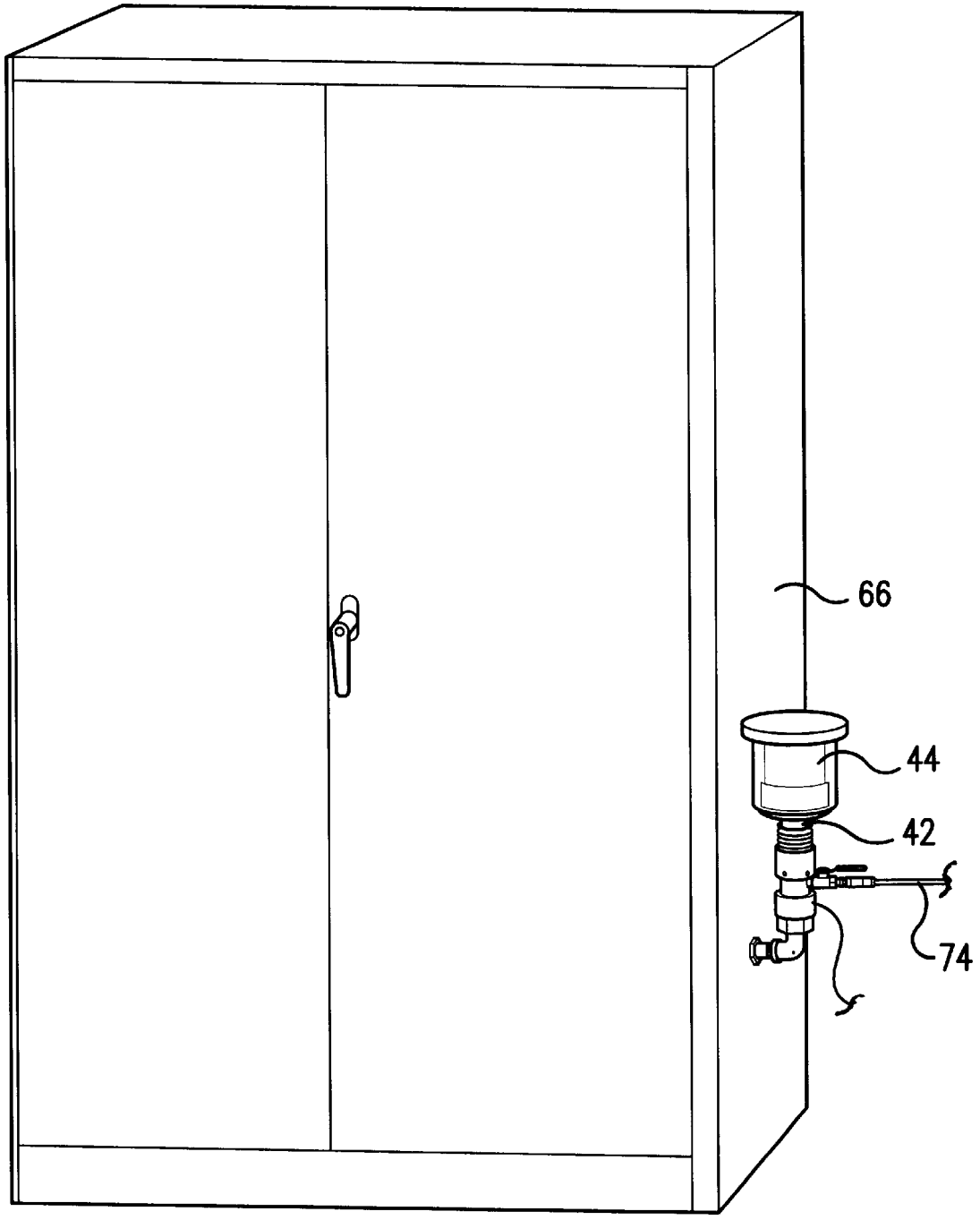
FIG. 2 is an isometric view of the vacuum air exhaust system of FIG. 1 mounted on a metal cabinet and being attached to a carbon/colormetric filter.
Figure 3:
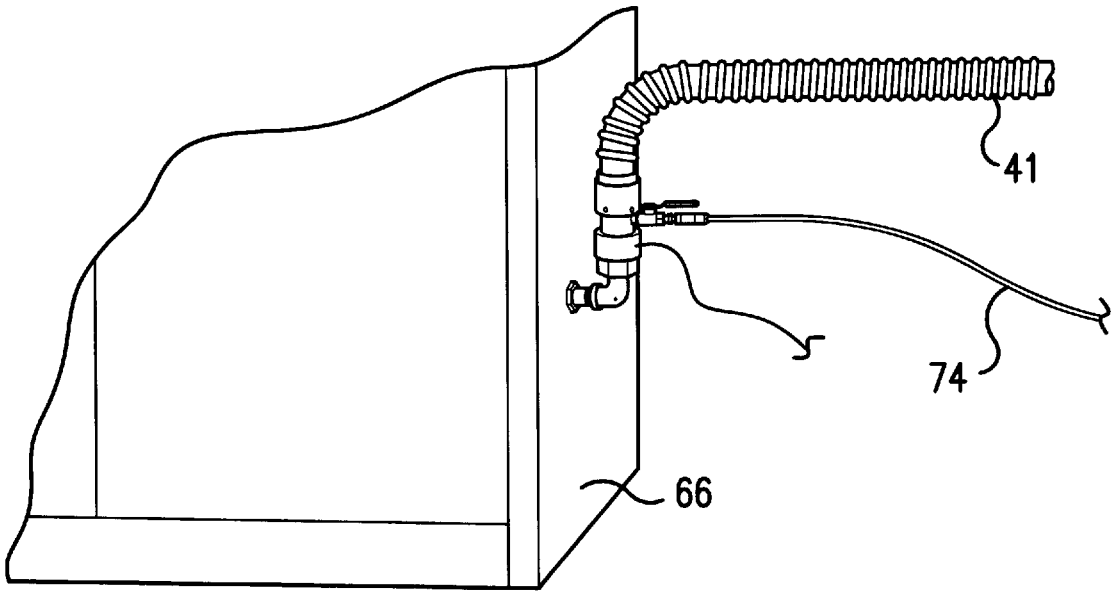
FIG. 3 is a cutaway isometric view similar to FIG. 2, but with the vacuum air exhaust system of this invention being attached to a flexible exhaust hose.

FIGS. 2 and 3 show the vacuum ventilation system 8 of this invention in two different configurations, one with the carbon/colormetric filter 44 being attached to female threads of the exhaust adapter 12 and the other with the flexible evacuator hose 41 receiving the external circular ribs 36 of the exhaust adapter 12. In the case of the filter of FIG. 2, contaminated air evacuated from the cabinet 66 is treated locally by the filter 44 and released to atmosphere, while in the case of the flexible evacuation hose 41 of FIG. 3, air contaminated with fumes is evacuated to a different location where it is treated or released to atmosphere.

The vacuum ventilation system is activated when the manual lever 78 is placed "in-line" with the output and input nipples 68 and 70 but it is completely shut off when the manual lever 78 is perpendicular to output and input nipple 68 and 70. Thus, the vacuum ventilation system can be used as being completely turned-on or turned-off. When it is turned on, fluid flows through the control valve unit 18, the vacuum pump 10, and the exhaust adapter 12 and thereby causes a suction that evacuates, or ventilates, air and fumes from the cabinet 66.

In addition, two other types of control are provided. In this regard, a selectively graduated amount of vacuum can be applied to the interior of the cabinet 66 by controlling the degree to which the ball valve in the ball valve unit 76 is opened by the manual lever 78. This provides a ready control of the vacuum ventilation system 8 to thereby meet individual vacuum (ventilation) requirements. Further, an angular position of the pump exhaust tube 28 determines a maximum amount of suction, or vacuum. The vacuum ventilation system 8 comes from the factory with the pump exhaust tube 28 and knurl-retaining nut 30 being preset at a recommended maximum air vacuum setting.

If the maximum-possible air vacuum that can be achieved by the vacuum pump 10 is too great for a particular use, the vacuum pump 10 can be mechanically adjusted to another predetermined maximum vacuum rate. For example, it could be adjusted so that one must only use the manual lever 78 as an on/off switch. In any event, in order to adjust the maximum predetermined vacuum rate of the vacuum pump 10, an Allen wrench is used to loosen the recessed setscrews 34 on the exhaust adapter 12 and the exhaust adapter 12 is removed from the vacuum pump 10. The knurled retaining nut 30 is rotated to loosen the pump exhaust tube 28. The pump exhaust tube 28 is then turned clockwise to decrease maximum vacuum and counterclockwise to increase maximum vacuum. Once a proper maximum vacuum rate is set for the vacuum pump 10 the knurled retaining nut 30 is again hand-tightened for holding the pump exhaust tube 28 in its new location. The exhaust adapter 12 is then replaced on the vacuum pump 10 and the setscrews 34 are tightened with a minimal force to retain the exhaust adapter 12 on the vacuum pump 10.

The vacuum ventilation system 8 normally does not require any maintenance. Should the vacuum pump 10 become clogged so that it does not operate at optimum levels, the procedure described above for adjusting a maximum vacuum rate can be followed to remove the pump exhaust tube 28 so that the vacuum pump 10 can be cleaned out.

It should be understood that the vacuum ventilation system of this invention provides an economical structure for creating a high vacuum flow and high exhaust flow with a minimal amount of compressed air. A controlled vacuum flow is provided at a pump vacuum inlet side of the vacuum ventilation system to steadily evacuate volatile organic compounds (VOCs) from safety storage cabinets, small hazardous material storage sheds, crushers, balers, parts washers, and the like. The rate of evacuation can be readily increased or decreased and the maximum rate can be easily changed.

Figure 4:
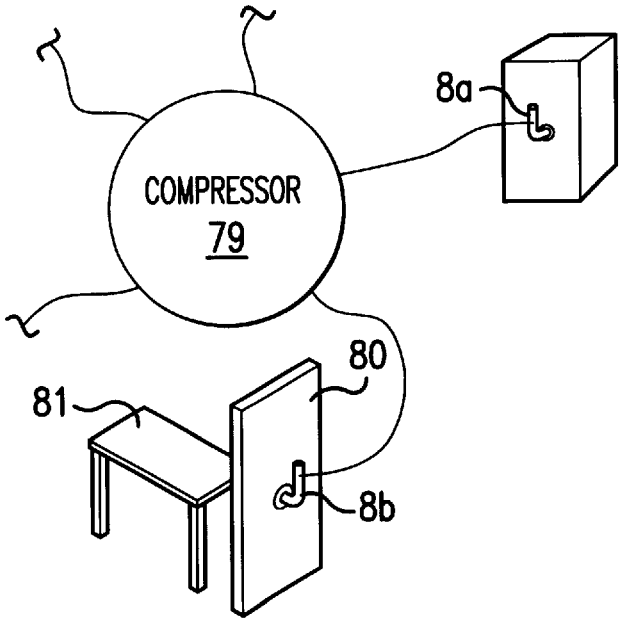
FIG. 4 is a schematic view of an arrangement of a plurality of vacuum air exhaust systems of this invention being serviced by a single compressor.

It should also be understood that the mount unit 16 can have various configurations for meeting requirements of particular sites to be ventilated; however, the pipe/rigid-flange mount depicted in FIG. 1, and shown mounting the vacuum ventilation system in FIGS. 2 and 3, is particularly beneficial for any storage and work area surrounded by, or adjacent to, a wall. That is, the pipe mount unit, with a pipe for passing through the wall and into the vacuum pump 10, is a very efficient structure for both mounting and carrying out ventilation. In this regard, FIG. 4 depicts a plurality of vacuum ventilation systems of this invention, all being serviced by a single compressor 79 with one vacuum ventilation system 8*a* being mounted on an enclosure 66*a* and another vacuum ventilation system 8*b* being mounted on a wall 80 adjacent a work station 81.

One tremendous benefit of this system is that it does not create the danger of sparks, contrary to electric blowers and fans.

Of course, it is beneficial to make the vacuum ventilation system of this invention to precise tolerances for providing consistent dependable performance. Also, it is beneficial for the unit to have an anodize finish so that it resists chemical attacks and has minimized wear. There are no moving parts, o-rings or gaskets to maintain or replace.

As mentioned above, a tremendous advantage of this system is that it can be easily adjusted to apply an exact amount of vacuum to a site; however, it also has the advantages of compactness of size, low pressurized air consumption, and easy activation and deactivation. Further, it is explosion proof and relatively portable for being moved between different work sites. Regarding portability, it can be easily dismounted and easily and securely mounted once again.

Although this invention has been described with reference to particular embodiments, it will be understood by those of ordinary skill in the art that various modifications are possible within the scope of this invention. For example, the control valve unit 18 need not be a ball valve as is described herein, but can be other types of valves. Further, although in the preferred embodiment it is highly beneficial to have a local manual control element, such as the manual lever 78, at the vacuum pump 10 as shown in FIG. 1, in another, not depicted, embodiment, the valve is remotely controlled. However, in either case, the control valve unit 18 itself is best rigidly attached to the vacuum pump 10.

Further, the exhaust adapter 12 can have various configurations and indeed can be completely avoided by attaching a filter or exhaust hose directly to the pump exhaust tube 28. However, the exhaust adapter 12 of the preferred embodiment provides benefits by having both the external ribs 36 and the internal threads 38. This structure allows the vacuum ventilation system to be easily attached to different types of exhaust processing units, such as the filter 44 and the flexible evacuation hose 41, respectively depicted in FIGS. 2 and 3. The mount system could be rigidly attached to the vacuum pump via the control valve unit.

It has already been pointed out above, that the mount unit 16 can have other forms but that the particular forms depicted and/or described herein have advantages.

I claim:

1. A vacuum ventilation system comprising:

a venturi vacuum pump unit including a vacuum-pump housing defining a compressed-air inlet, a pump vacuum inlet, and a pump exhaust port, said vacuum pump unit receiving compressed air at said compressed-air inlet and exhausting said compressed air at said pump exhaust port, with a flow of said compressed air through said vacuum-pump housing causing a venturi ventilation suction at said pump vacuum inlet;

a control-valve unit rigidly attached to said vacuum-pump housing at said compressed-air inlet and including a movable valve for regulating flow of compressed fluid through said control-valve unit to said compressed-air inlet, said control valve unit having an upstream inlet for receiving compressed air from a compressed-air source and regulating the amount of compressed air fed to said compressed-air inlet of said vacuum pump housing in response to movement of said movable valve and thereby controlling the amount of ventilation suction at said pump vacuum inlet; and a mount system rigidly attached to said venturi vacuum pump unit for mounting said vacuum ventilation system at a work station, wherein said mount system includes a rigid mount adapter having a first end for being rigidly attached to said vacuum-pump housing at said pump vacuum inlet and a second end for being rigidly attached to a pipe through which a ventilation suction at said pump vacuum inlet is applied.

2. The vacuum ventilation system of claim 1 wherein said control valve unit includes a manual handle attached to said movable valve for being manipulated by an operator at said work station.

3. The vacuum ventilation system of claim 2 wherein said mount adapter includes flat sides about a periphery thereof and internal threads for being screwed to said pipe.

4. The vacuum ventilation system of claim 2 wherein said mount adapter is adhered to said vacuum pump housing by an adhesive.

5. The vacuum ventilation system of claim 2 wherein said mount system further includes a pipe mount unit having said pipe attached to said mount adapter and a mounting means for rigidly mounting said pipe mount unit to a wall of a housing by passing through said wall, whereby the said ventilation suction is applied to a side of said wall opposite a side on which said vacuum pump unit is located.

6. The vacuum ventilation system of claim 2 wherein is further included an exhaust adapter for being mounted on said vacuum pump housing and for being attached to an exhaust processing unit.

7. The vacuum ventilation system of claim 6 wherein said exhaust adapter has both external circular ribs for being inserted into a flexible hose and internal threads for mating with male threads of a pipe.

8. The vacuum ventilation system of claim 6 wherein said system further includes said exhaust processing unit and wherein said processing unit is a filter.

9. The vacuum ventilation system of claim 6 wherein said system further includes said exhaust processing unit and wherein said exhaust processing unit is a flexible hose.

10. The vacuum ventilation system of claim 1 wherein said mount adapter includes flat sides about a periphery thereof and internal threads for being screwed to a pipe.

11. The vacuum ventilation system of claim 1 wherein said mount adapter is adhered to said vacuum-pump housing by an adhesive.

12. The vacuum ventilation system of claim 1 wherein said mount system further includes a pipe mount unit having said pipe attached to said mount adapter and a mounting means for rigidly mounting said pipe mount unit to a wall of a housing by passing through said wall, whereby the said ventilation suction is applied to a side of said wall opposite a side on which said vacuum pump unit is located.

13. The vacuum ventilation system of claim 1 wherein is further included a filter which is substantially rigidly attached to said vacuum pump housing at said pump exhaust port.

14. The vacuum ventilation system of claim 1 wherein said mount system includes a pipe mount unit having a first pipe end portion attached to said mount adapter and including a second pipe end portion for passing through a wall and having an attaching means thereon for rigidly attaching said pipe to said wall, whereby said ventilation suction is applied through said pipe and said wall.

15. The vacuum ventilation system of claim 14 wherein said attaching means includes flanges for engaging opposite sides of said wall.

16. The vacuum ventilation system of claim 14 wherein is further included an exhaust adapter for being selectively mounted on said vacuum pump housing at said pump exhaust port for being attached to an exhaust processing unit.

17. A vacuum ventilation arrangement including a single compressor and a plurality of vacuum ventilation systems of claim 1, with the vacuum pump housing of each system being fed compressed air at its compressed-air inlet by the compressor.

18. A vacuum ventilation system comprising:

a venturi vacuum pump unit including a vacuum-pump housing defining a compressed-air inlet, a pump vacuum inlet, and a pump exhaust port, said vacuum pump unit receiving compressed air at said compressed-air inlet and exhausting said compressed air at said pump exhaust port, with a flow of said compressed air through said vacuum-pump housing causing a venturi ventilation suction at said pump vacuum inlet;

a compressed-air receiver attached to said vacuum-pump housing at said compressed-air inlet having an upstream inlet for receiving compressed air from a compressed-air source and feeding said compressed air to said compressed-air inlet of said vacuum pump housing and thereby creating ventilation suction at said pump vacuum inlet; and a pipe mount unit rigidly attached to said vacuum pump housing at said pump vacuum inlet and including a pipe for passing through a wall and having an attaching means thereon for rigidly attaching said pipe to said wall whereby said ventilation suction is applied through said pipe and said wall.

19. The vacuum ventilation system of claim 18 wherein said attaching means includes flanges for engaging opposite sides of said wall.

20. A vacuum ventilation arrangement including a single compressor and a plurality of vacuum ventilation systems of claim 18, with the vacuum pump housing of each system being fed compressed air at its compressed-air inlet by the compressor.

* * * * *